US008037836B2

(12) United States Patent
Carmichael et al.

(10) Patent No.: US 8,037,836 B2
(45) Date of Patent: Oct. 18, 2011

(54) AUTOMATED BOAT WASHING SYSTEM

(76) Inventors: Ian M. Carmichael, Boca Raton, FL (US); Ian F. Carmichael, Boca Raton, FL (US)

( * ) Notice: Subject to any disclaimer, the term of this patent is extended or adjusted under 35 U.S.C. 154(b) by 66 days.

(21) Appl. No.: 12/109,620

(22) Filed: Apr. 25, 2008

(65) Prior Publication Data

US 2009/0266284 A1 Oct. 29, 2009

(51) Int. Cl.
*B63B 59/00* (2006.01)

(52) U.S. Cl. ..... 114/222

(58) Field of Classification Search ..... 114/222
See application file for complete search history.

(56) References Cited

U.S. PATENT DOCUMENTS

| | | | | |
|---|---|---|---|---|
| 637,702 | A | 11/1899 | Branch | |
| 3,227,124 | A | 1/1966 | Campbell | |
| 3,561,391 | A | 2/1971 | Locati | |
| 3,603,510 | A * | 9/1971 | Wagner | 239/282 |
| 3,742,520 | A * | 7/1973 | Bernardi | 4/662 |
| 3,773,059 | A | 11/1973 | Arneson | |
| 3,800,732 | A | 4/1974 | Hill | |
| 4,030,440 | A | 6/1977 | Wickersham | |
| 4,204,494 | A | 5/1980 | Bridwell et al. | |
| 5,906,226 | A * | 5/1999 | Goodman | 138/109 |
| 5,975,423 | A | 11/1999 | Rice et al. | |
| 6,263,826 | B1 * | 7/2001 | Key | 114/343 |
| 6,857,583 | B2 | 2/2005 | Attar | |
| 6,988,458 | B1 * | 1/2006 | Walker | 114/222 |
| 7,077,338 | B1 | 7/2006 | Williamson | |
| 7,210,637 | B1 | 5/2007 | Johnson | |
| 2004/0074431 | A1 * | 4/2004 | Tible | 114/222 |
| 2005/0243655 | A1 * | 11/2005 | McCutcheon et al. | 368/107 |

* cited by examiner

*Primary Examiner* — Stephen Avila
(74) *Attorney, Agent, or Firm* — John C. Smith

(57) ABSTRACT

A self-contained boat cleaning system that dispenses water, soap, wax and/or spot-free rinse chemicals. Cleaning fluids are distributed via conduits which can be concealed inside the rub rail, mounted near the rub rails or other surfaces of the boat, or alternatively can be installed inside the bulkheads of the vessel. Fluid apertures direct the spray of water and/or cleaning fluids to predetermined surfaces of the boat. A pump and associated reservoir system (containing built in reservoirs for cleaning fluids, chemicals, waxes, spot-free chemicals, etc) can be mounted anywhere inside the vessel. The water supply used by the system can be supplied either from shore water or from a fresh water holding tank on board and fed into the onboard water filtration system. An optional timer which can be used to start the process at predetermined times. In addition, the boat washing system can be activated via remote control.

18 Claims, 11 Drawing Sheets

AUTOMATED BOAT WASHING SYSTEM

BACKGROUND

1. Technical Field

This invention relates in general to a boat washing system, and more particularly it relates to an automatic boat washing system which can clean a boat on a one-time basis via onboard switches, or by remote control. Further, it includes a novel method of concealing conduits carrying water, waxes, cleaning fluids, etc., such that the system remains in place at all times, but it is not noticeable to a casual observer.

2. Background of the Invention

Boating is a pleasurable activity for many people. However, proper maintenance of boats requires a substantial amount of time and effort. In addition to maintenance of mechanical and electrical components, it is also important to maintain a boat in a clean condition. Unfortunately, the simple act of maintaining a boat in a clean condition can be costly, and time-consuming. It would be desirable to have a method of inexpensively cleaning a boat without the use of external cleaning equipment, manpower, and the expense associated with external devices.

In the prior art, a number of attempts have been made to provide cleaning systems for boats. Some systems have been developed which use external brushing equipment to scrub the underside of the boat's hull. These systems generally require that the boat be driven up to the edge of a pier to allow brushes to reach the hull of the boat for cleaning. In addition, the boat then has to be turned around to allow the other side of the hull to be cleaned.

Variations of the system include brush assemblies which are arranged on both sides of the boat for cleaning in a single pass. Likewise, systems have been developed which use high-pressure water flows in place of brush assemblies for cleaning the underwater portion of hulls. A common disadvantage associated with all of these approaches is the requirement that substantial, and expensive, equipment be used for the purpose of cleaning the hull. Further, these systems are typically designed to clean only the portion of the hull which is underwater, and does not provide any facility for cleaning the superstructure (i.e., the topside) of the boat. It would be desirable to have a system which could clean a boat without a requirement for any external equipment, and which could also be used to clean the superstructure of the boat as well as the hull.

Another attempt to provide systems for cleaning boats has been the development of brush assemblies which are used on a boat after it has been lifted out of the water. The solution typically uses a forklift or other carrying device to move the boat's hull over a brush assembly. Of course, the disadvantage associated with this approach is the substantial cost of equipment, as well as the time and effort required to complete this cleaning procedure. It would be desirable to have a method of cleaning a boat on a regular basis, without having to lift the boat from the water in order to be used with external cleaning equipment.

Yet another attempt to keep boats clean has been the use of a manually operated water hose to spray down a boat after use. As is the case with other cleaning systems, this would require the boat owner to move the boat so as to have access to the other side of the hull while standing on a dock. It would be desirable to have a method of cleaning the boat which did not require the boat owner to manually spray the boat with a water hose.

The prior art boat cleaning systems in use today, generally provide an expensive and inconvenient method of cleaning a boat. Typically, prior art cleaning methods require the boat owner or a cleaning service to be present at the time of cleaning. It would be desirable to have a method of cleaning a boat which does not require the presence of the owner or personnel from cleaning services, and/or which would allow the cleaning process to be started automatically on a timed basis, or via remote control.

While the prior art has provided a number of devices and systems for cleaning boats, it has failed to provide a system which requires no external equipment, which can operate automatically in the absence of the owner, which can be controlled remotely, and which can be generally concealed such that it does not detract from the appearance of the boat.

SUMMARY OF THE INVENTION

This invention provides an automated wash/rinse down apparatus for boats, and other marine vessels, which dispenses water, soap, wax and spot free rinse chemicals through onboard conduits and fluid apertures to the hull and superstructure of boats. A system of conduits distributes water, cleaning fluids, and/or waxes to the external surface of the boat, including both the hull and/or the superstructure. This system delivers cleaning fluids through conduits at the gunnels, and optionally at other locations on the boat. Further, the conduits can be incorporated inside the rub rail material itself, thereby eliminating the need for separate conduits. Alternatively, conduits can be affixed to the hull and topsides with adhesive materials or tie downs. The conduits utilize a plurality of fluid apertures to direct the spray of water and/or cleaning fluids to predetermined surfaces of the boat or vessel. The conduits could also be installed inside the bulkheads of the vessel with only the sprayer heads visible from the outside. A pump and manifold (containing built in reservoirs for cleaning fluids, chemicals, waxes, etc) can be mounted at any convenient location inside the vessel. The water supply used by the system can be supplied either from shore water or from a fresh water holding tank on board. Optionally, an automated timer switch which can be used to start the process at a predetermined times. In addition, an optional hand held remote control can be used for on demand to activate the boat washing system.

DETAILED DESCRIPTION OF THE PREFERRED EMBODIMENT

Prior to a discussion of the figures, an overview of the invention will be presented. The invention uses a concealed cleaning system which allows a boat owner to automatically rinse/wash a boat at a preselected time, or at an arbitrary time via a manual switch or a remote control. Water and/or cleaning agents are distributed via conduits that are concealed at various locations on a boat. This allows the system to remain on board at all times and be virtually unnoticeable by users. As a result, the aesthetic appearance of the boat is not affected by the boat washing system. Since the system is permanently in place, no work is required each time the boat is to be washed. Likewise, an alternative system uses conduits that are distributed inside the hull to fluid apertures that extend through the hull to spray water and/or cleaning fluid against the outside surface of the hull during the cleaning process. Yet another alternative embodiment uses conduits which are secured to the outside of the hull, and placed adjacent pre-existing components such as the rub rail in such a manner that they are substantially unnoticeable. An advantage provided by the invention is that there is no expensive external equipment that needs to be used to clean the boat. Further, the boat can be cleaned in any location, at any time, and without requiring an individual to actively spend time cleaning the boat.

For the purposes of this disclosure, the term "fluid apertures" will be defined as any mechanism which allows fluid to be ejected from the conduits. It can be a discrete nozzle, spray head, and aperture in the conduit, perforations in the conduit, or any other suitable device for expelling fluid toward the hull of a boat.

An optional timer allows the boat to be cleaned when the boat owner is absent, thereby saving substantial amounts of time for the boat owner, and further allowing the boat to be cleaned on a predetermined cleaning schedule that is convenient for the boat owner. In addition to the optional timer, the boat cleaning system can be controlled with an optional remote control. The remote control allows the boat owner to arbitrarily start and stop the cleaning process at the boat owner's convenience.

An additional advantage provided by the invention is that the convenience of the self-contained system provides an incentive for the boat owner to clean the boat more often, and thus maintain the boat in better condition. Further, a method of concealment used by the invention, in which the conduits are concealed within the rub rails, provides a system which does not detract from the overall appearance of the boat.

Having discussed the invention in general, we turn now to a detailed discussion of the drawings.

Figure 1:
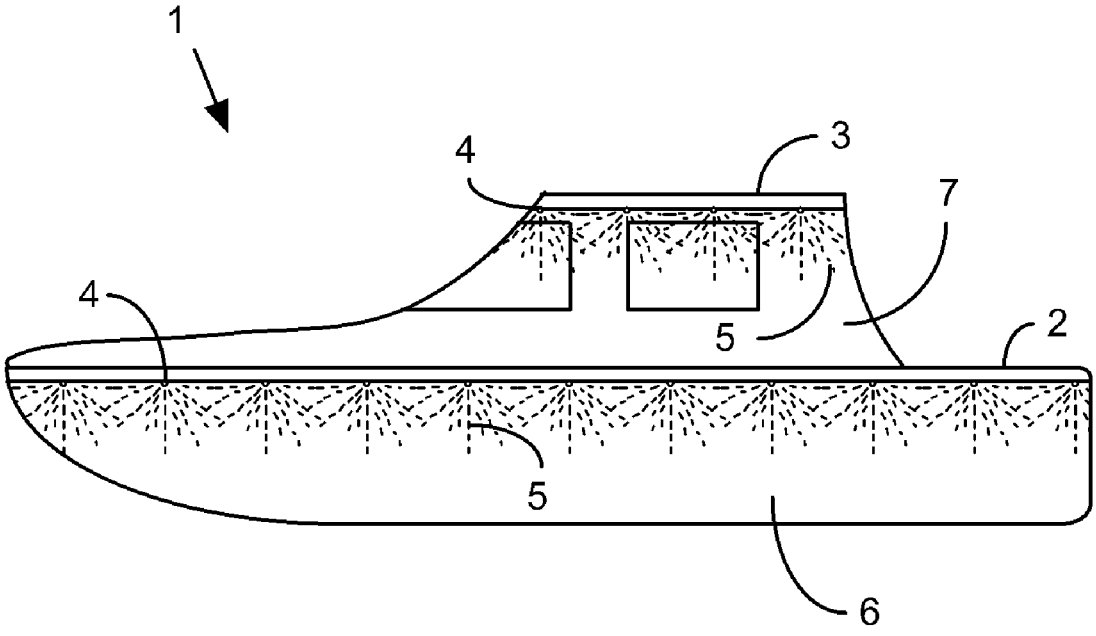
FIG. 1 is a side view of a preferred embodiment of the system which uses conduits incorporated into the rub rails of a boat. Fluid apertures are shown dispensing cleaning fluid to the hull and to the superstructure.

FIG. 1 is a side view of a preferred embodiment of the automatic boat cleaning system which uses conduits (illustrated in FIGS. 2A-B) that are incorporated into the rub rails 2 of a boat 1, as well as matching upper rails 3 on the superstructure 7 of boat 1. Fluid apertures 4 are shown dispensing cleaning fluid 5 to the hull 6 and to the superstructure 7. The cleaning agents used can be water, any other cleaning fluid that is suitable for the particular: question, or even wax.

A significant advantage provided by the invention is that it can be completely self-contained on the boat 1. In addition, the components are permanently mounted which eliminates the need to unpack the components prior to cleaning, and to store them after cleaning. This provides the boat owner the freedom of being able to wash the boat 1 at any time, and that any location with a minimum amount of inconvenience. Prior art systems which use expensive external equipment do not provide this freedom of use.

Figure 2A:
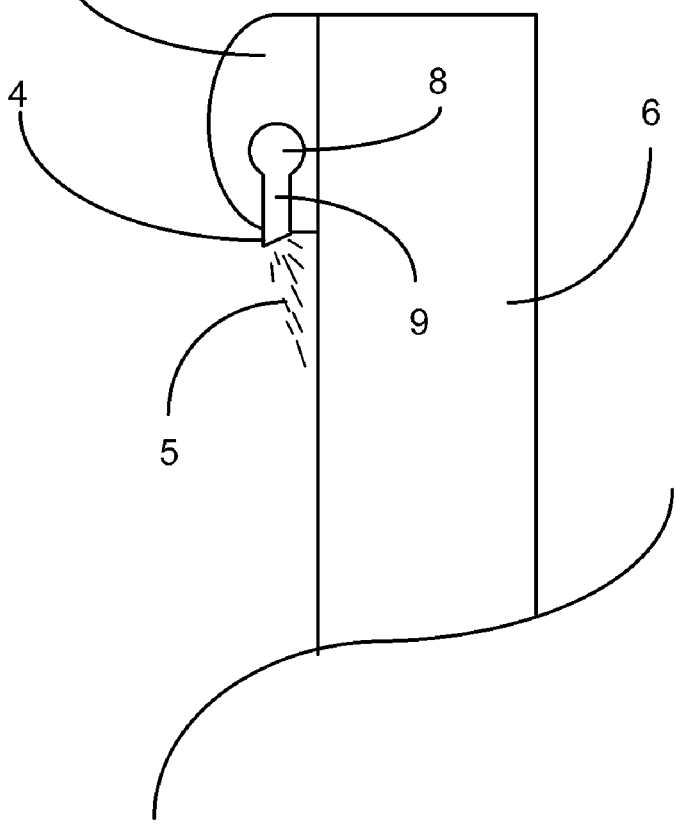
FIG. 2A is an edge cross-sectional view of a preferred embodiment of the cleaning fluid conduit concealed within the rub rail of a boat, and the fluid aperture is shown extending from the conduit to the outside of the rub rail and spraying cleaning solution against the hull of the boat.

FIG. 2A is an edge cross-sectional view of a preferred embodiment of the cleaning fluid conduit 8 concealed within the rub rail 2 of a boat 1. The fluid aperture 4 is shown extending from the conduit 8 to the outside of the rub rail 2 and spraying cleaning solution 5 against the hull 6 of the boat 1. In this figure, fluid aperture 4 is merely a shaped aperture which is designed to direct fluid in the direction of the hull 6. A fluid channel 9 is also shown. Fluid channel 9 provides a fluid path from cleaning fluid conduit 8 to each of the spray nozzles 4. Those skilled in the art will recognize that cleaning fluid conduit 8 can be a discrete component embedded within rub rail 2, or alternatively, it can be molded as an integral structure of rub rail 2, or it can be an independent conduit which is secured to the boat 1 in a convenient location, such as adjacent to rub rail. An advantage provided by construction of the rub rail 2 with an integral cleaning fluid channel 8 is that it minimizes components, minimizes cost, and simplifies the invention since rub rails 2 are typically used on most boats 1. In addition, it provides cleaner and more appealing aesthetics.

Figure 2B:
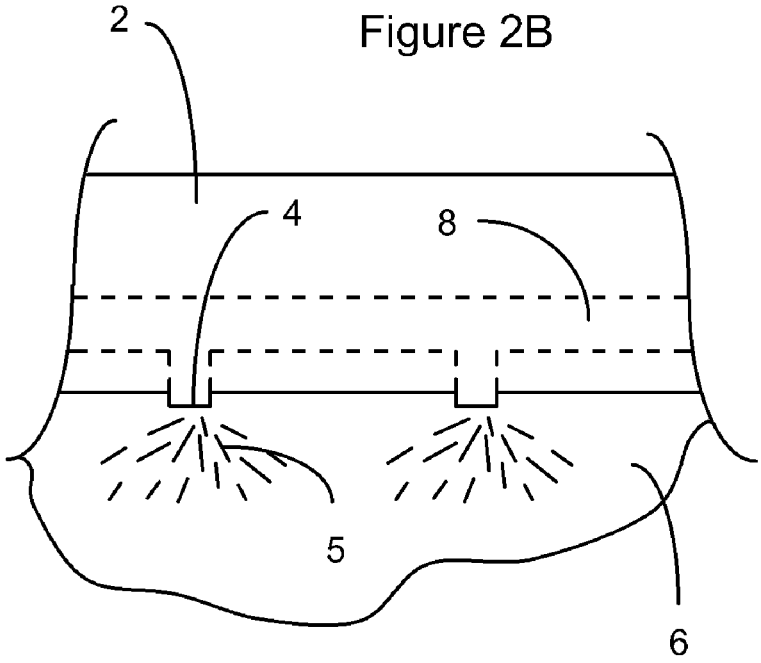
FIG. 2B is a side transparent view of a preferred embodiment of the cleaning fluid conduit concealed within the rub rail of a boat, and the fluid aperture is shown extending from the conduit to the outside of the rub rail and spraying cleaning solution against the hull of the boat.

FIG. 2B is a side transparent view of a preferred embodiment of the invention. As can be seen, the cleaning fluid conduit 8 news concealed within the rub rail 2 of a boat 1. The fluid aperture 4 is shown extending from the cleaning fluid conduit 8 to the outside of the rub rail 2 and spraying cleaning solution 5 against the hull 6 of boat 1.

Figure 3:
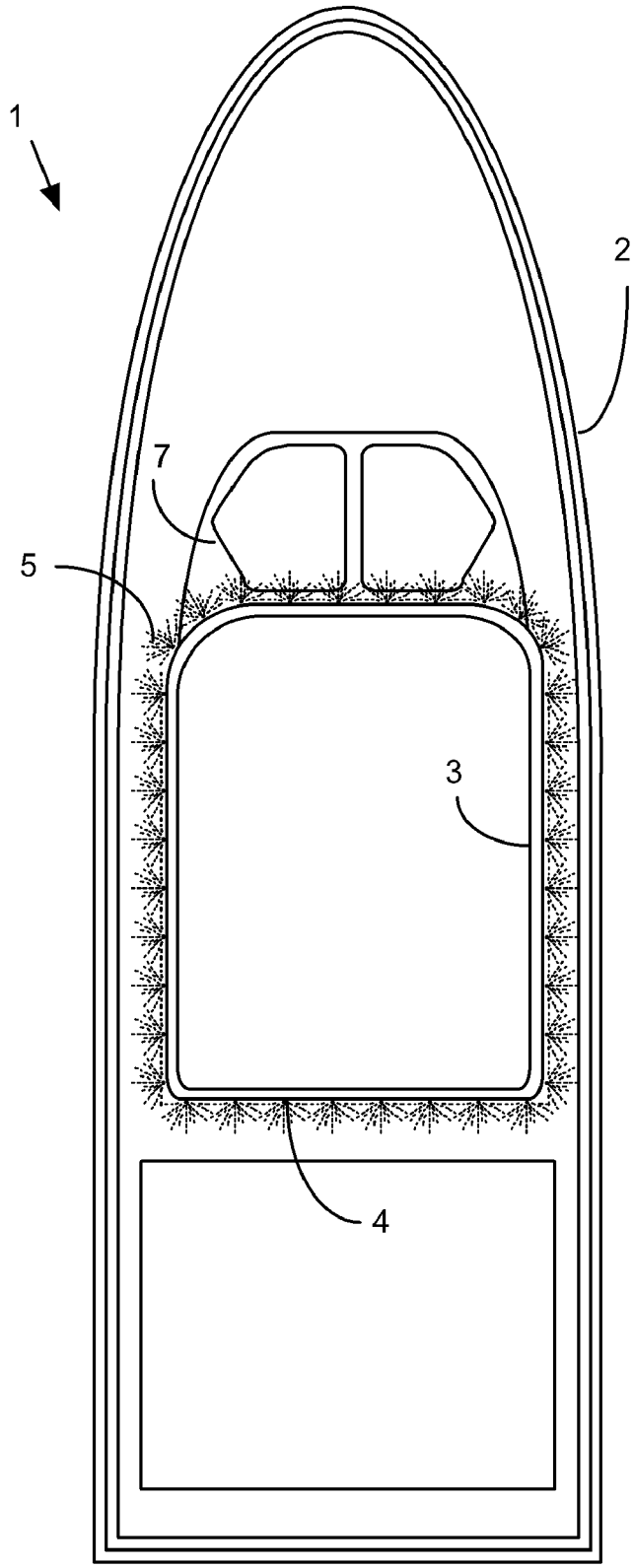
FIG. 3 is a top view of a preferred embodiment of the invention showing the boat superstructure being cleaned by fluid apertures spraying cleaning fluid.

FIG. 3 is a top view of a preferred embodiment of the invention showing the boat 1 superstructure 7 being cleaned by fluid apertures 4 spraying cleaning fluid 5. Those skilled in the art will recognize that while the hull 6 would typically also be sprayed at this time, the actual spray is not visible from this angle. For ease of illustration, the fluid apertures 4 are shown arranged round the upper edge of the superstructure 7. However, those skilled in the art will recognize that fluid apertures 4 can be distributed such that the entire surface of the boat 1 is cleaned.

Figure 4:
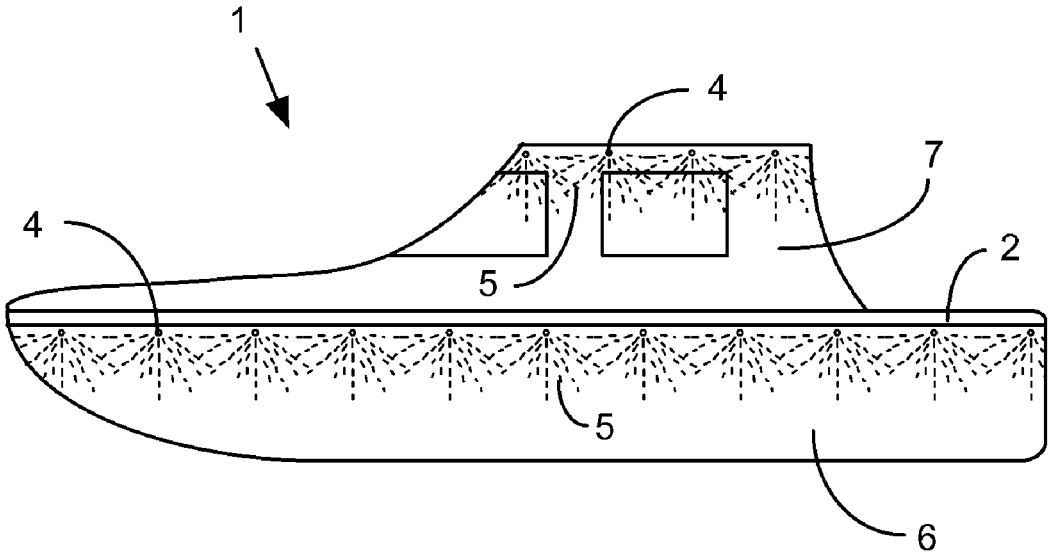
FIG. 4 is a side view of a preferred embodiment of the system which uses conduits secured to the hull of a boat. Fluid apertures are positioned at predetermined points on the hull and the superstructure, and are shown dispensing cleaning fluid to the hull and to the superstructure.

FIG. 4 is a side view of a preferred embodiment of the automatic boat cleaning system which uses conduits 8 that are secured to the hull 6, and the superstructure 7, of a boat 1. Fluid apertures 4 are positioned at predetermined points on the hull 6 and the superstructure 7, and are shown dispensing cleaning fluid 5 to the hull 6 and to the superstructure 7. As mentioned above, the fluid apertures 4 are shown near the rub rail 2 and near the top of the superstructure 7 for ease of discussion. However, those skilled in the art will recognize that when the cleaning fluid conduits 8 are routed through the hull 6 of the boat 1, there is no restriction on where they are placed. This allows fluid apertures 4 to be placed such that the entire surface of the boat 1 can be sprayed with cleaning fluid 5 if desired.

Figure 5A:
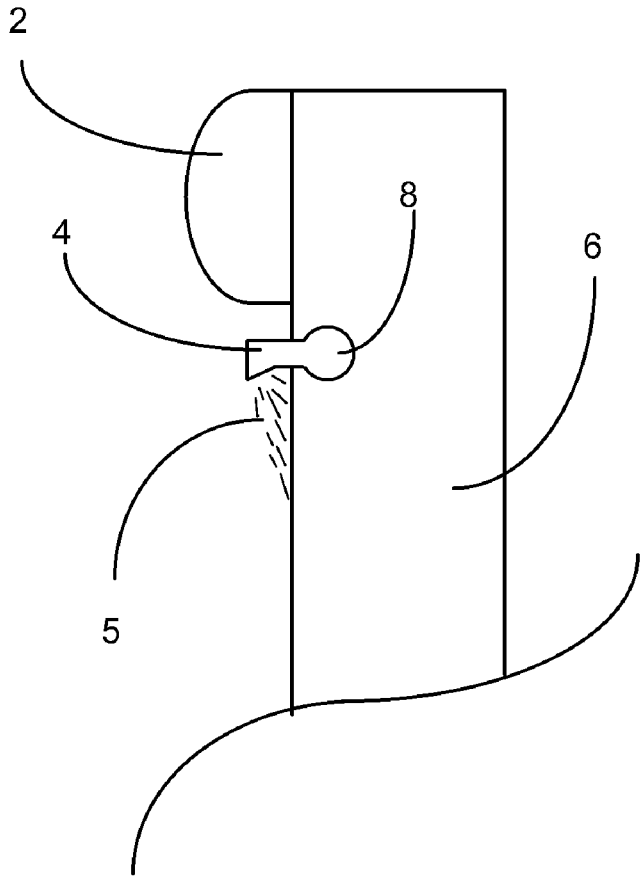
FIG. 5A is an edge cross-sectional view of a preferred embodiment of the cleaning fluid conduit concealed within the hull of a boat, and the fluid aperture is shown extending from the conduit to the outside of the hull and spraying cleaning solution against the hull of the boat.

FIG. 5A is an edge cross-sectional view of a preferred embodiment of the cleaning fluid conduit 8 concealed within the hull 6 of a boat 1. The fluid aperture 4 is shown extending from the conduit 8 to the outside of the hull 6 and spraying cleaning solution 5 against the hull 6 of the boat 1.

Figure 5B:
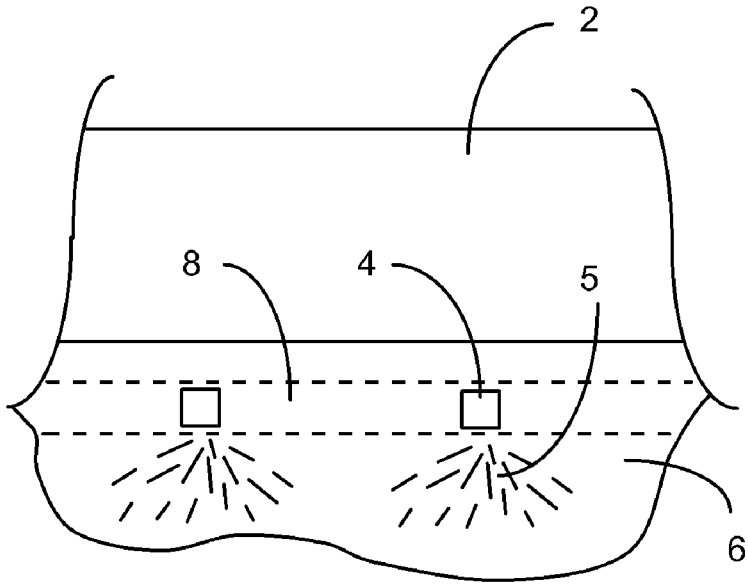
FIG. 5B is a side transparent view of a preferred embodiment of the cleaning fluid conduit concealed within the hull of a boat, and the fluid aperture is shown extending from the conduit to the outside of the hull and spraying cleaning solution against the hull of the boat.

FIG. 5B is a side transparent view of a preferred embodiment of the cleaning fluid conduit 8 concealed within the hull 6 of a boat 1. The fluid aperture 4 is shown extending from the conduit 8 to the outside of the hull 6 and spraying cleaning solution 5 against the hull 6 of the boat 1.

Figure 6:
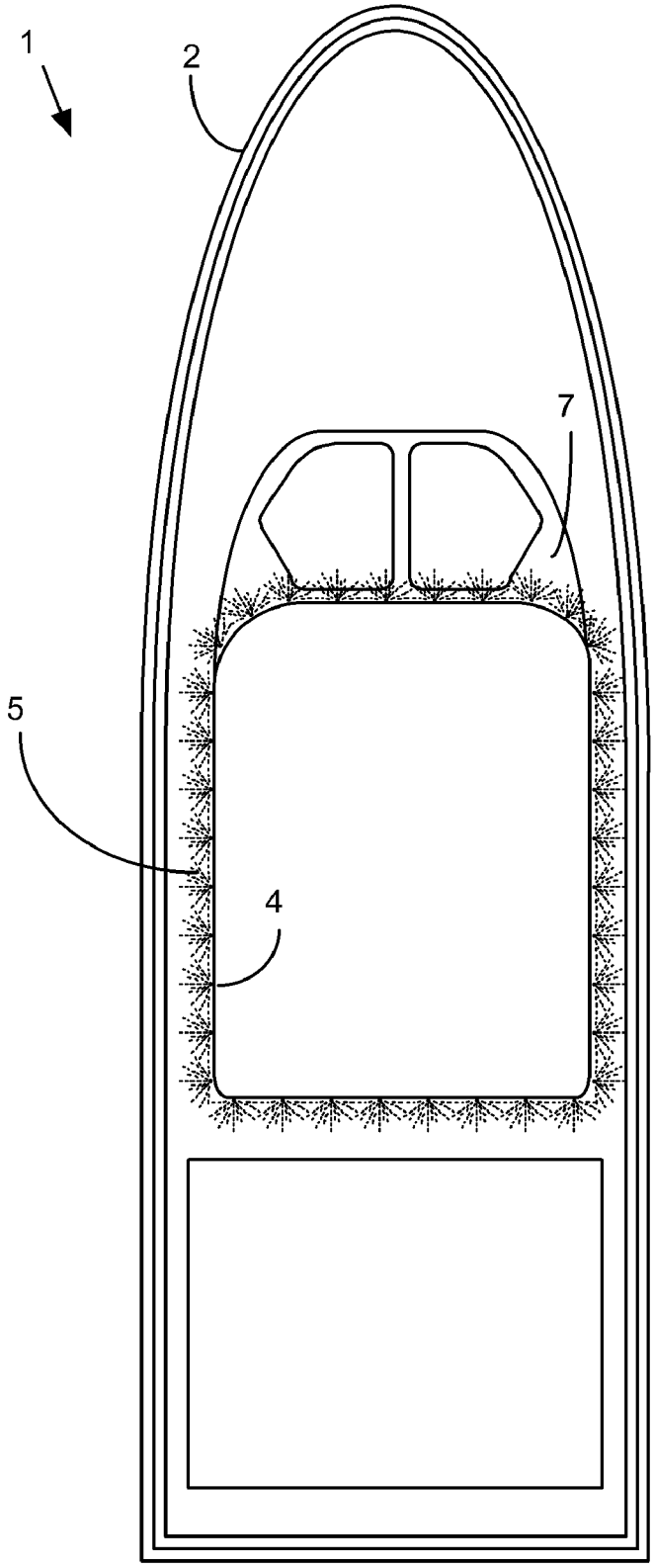
FIG. 6 is a top view of a preferred embodiment of the invention showing the boat superstructure being cleaned by fluid apertures extending from the superstructure surface, and spraying cleaning fluid toward the surface of the superstructure.

FIG. 6 is a top view of a preferred embodiment of the invention showing the boat 1 superstructure 7 being cleaned by fluid apertures 4. The fluid apertures 4 extend from the superstructure 7, spraying cleaning fluid 5 toward the surface of the superstructure 7.

Figure 7:
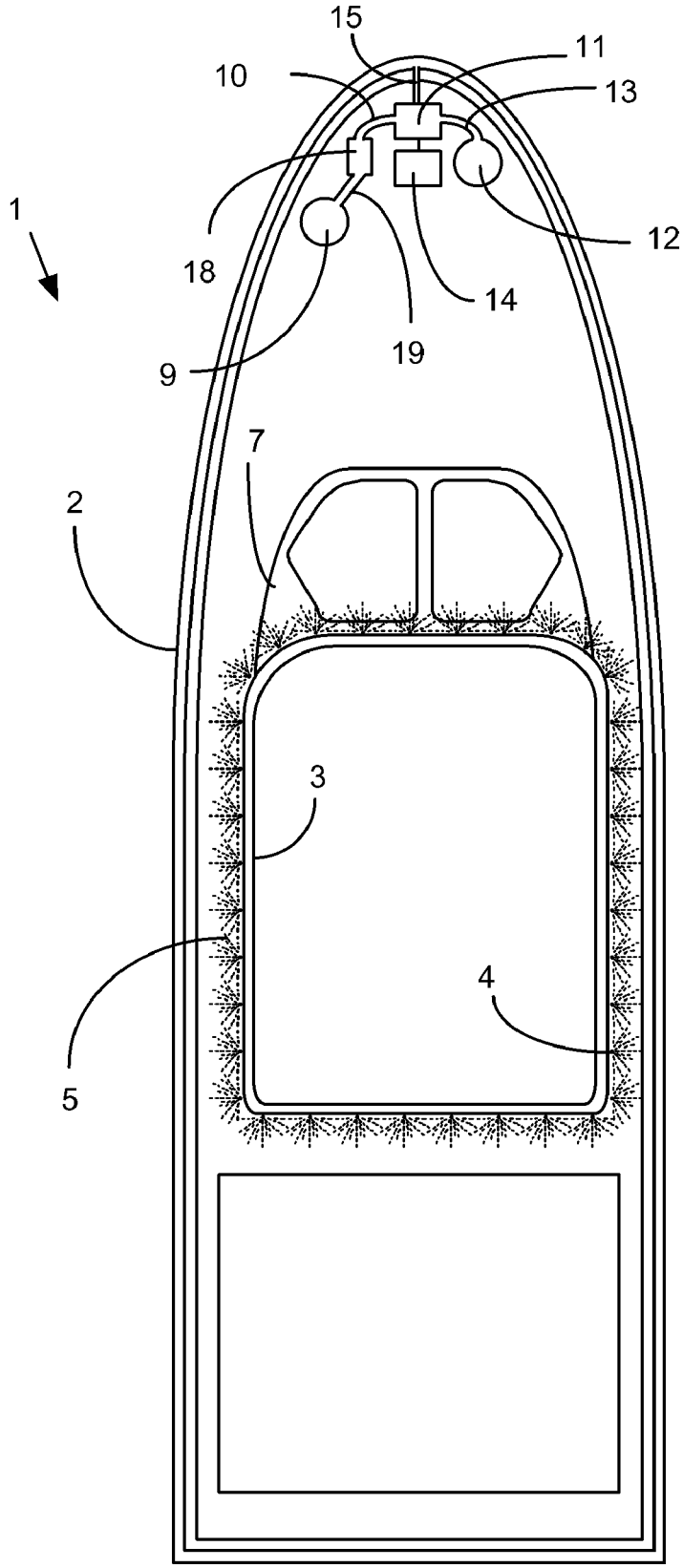
FIG. 7 is a top transparent view showing reservoirs for water, water filter, cleaning agents and/or wax, a pump assembly, and an optional timer/remote control assembly.

FIG. 7 is a top transparent view showing reservoirs for water 9, cleaning agents and/or wax 12, a pump assembly:, and an optional timer/remote control assembly 14. Water reservoir 9 is connected via conduit 19 to water filter 18 which outputs water to water conduit 10 and then to pump 11. Water reservoir 9 can supply water at ambient temperatures or, optionally, heat the water via an integral heater to further improve the cleaning capability of the system. Likewise, it can use heated water from the boat's onboard hot water system. In addition, heated water can be supplied from a water source external to the boat 1. The water temperature can also be controlled via a thermostat or via a programmable controller. Optional water filter 18 ensures that the cleanest possible water is available for washing the boat 1. The reservoir(s) for cleaning agents and/or wax 12 are connected via cleaning agent and/or wax conduit 13 to pump 11. For ease of illustration, the reservoirs 9 and 12, pump assembly 11, and timer/remote control assembly 14 or shown together near the bow of the boat 1. However those skilled in the art will recognize that these components can be located at any convenient location on the boat 1, and they may be separated from one another and each positioned independently at different positions on the boat 1.

Figure 8:
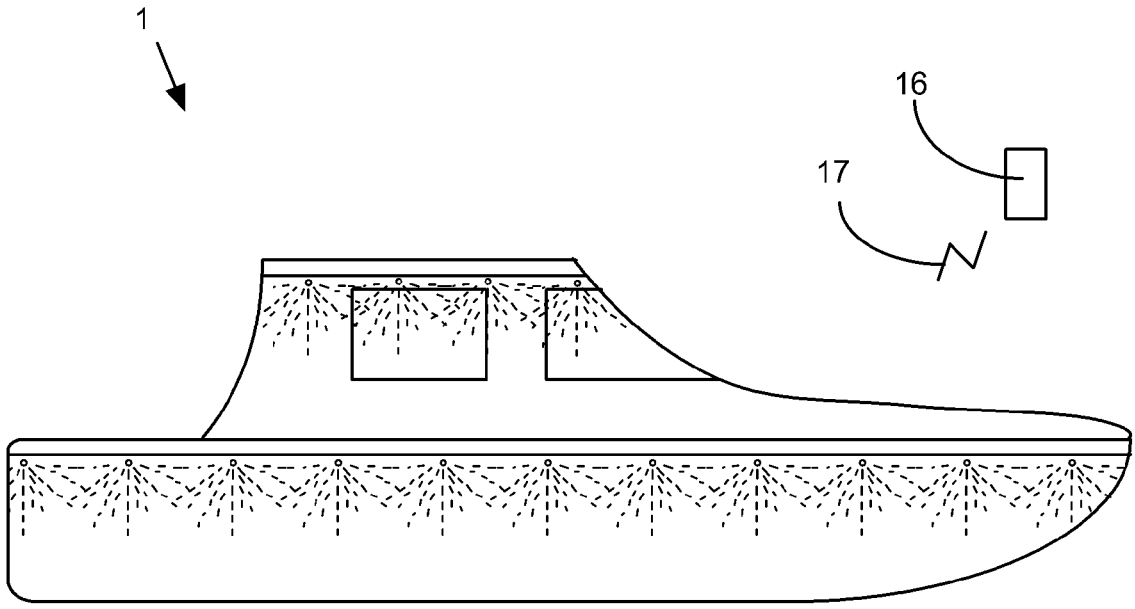
FIG. 8 is a side view illustrating the use of an optional remote control with the automatic boat washing system.

FIG. 8 is a side view illustrating the use of an optional remote control 16 with the automatic boat washing system. In the preferred embodiment, the remote control 16 transmits a signal 17 which is received by the timer/remote control assembly 14. Once signal 17 is received, the timer/remote control assembly 14 activates the automatic boat cleaning system. While a preferred embodiment envisions a conventional remote control unit, those skilled in the art will also recognize that it is possible to activate the automatic boat cleaning system from substantial distances, such as via a cellular phone link or via an Internet link to an onboard processor on the boat 1.

In a preferred embodiment, the automatic boat cleaning system takes a series of steps to clean a boat 1. First, the boat 1 is sprayed down with water and/or cleaning fluid. Then, it is rinsed again to get rid of any remaining cleaning fluid. Next, the boat 1 can be sprayed with wax which can be stored in a reservoir attached to the pump 11. Finally, it can be rinsed with a solution which will reduce water spots that naturally occur during the boat cleaning process. The entire process can be completely automated such that the boat owner is not required to be present to execute any of these steps. Further, the system can be programmable such that the boat owner can instruct the system, via a remote control or programmable onboard controller to execute one or more of the steps in the cleaning process. The same instructions can be issued using other communications systems, such as cell phone or Internet systems.

Figure 9A:
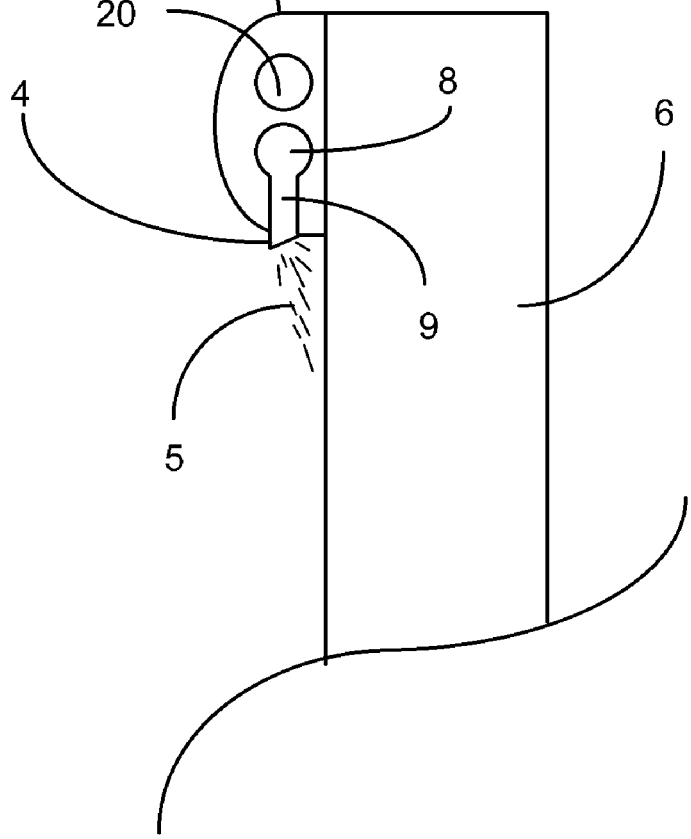
FIG. 9A is an edge cross-sectional view of a preferred embodiment of the invention in which multiple conduits are concealed within the rub rail of a boat.

In addition to the onboard reservoirs for water, and/or cleaning fluids, an optional external water and/or cleaning fluid feed can be attached to the system to allow external sources of water and/or cleaning fluids to be supplied FIG. 9A is an edge cross-sectional view of an alternative preferred embodiment of the automatic boat cleaning system in which multiple fluid conduits 8, 20 are concealed within the rub rail 2 of a boat 1. Of course, design choices based on the size of a boat 1 may indicate that a plurality of fluid conduits 8, 20 should be used rather than just two. For ease of discussion, the foregoing embodiments have been discussed in terms of a single conduit 8 system. While the use of a single conduit 8 would be perfectly adequate for smaller boats, larger boats and yachts may require more complicated multi-conduit systems in order to maintain proper fluid pressure. Those skilled in the art will recognize that a multi-conduit system can be zoned and control similar to a conventional lawn sprinkler system which waters different zones at different times for the purpose of maintaining water pressure and also to control how much water goes to each zone. The system disclosed herein can be organized such that areas of the boat that require greater effort to clean can be given longer washing periods, can be washed more often than other areas, etc. Of course, the system can be managed by a conventional switching system and timers, operated manually, or controlled by an onboard computer which can have preprogrammed instructions or can receive instructions via communication links such as for my cell phone connection or a remote Internet connection.

Figure 9B:
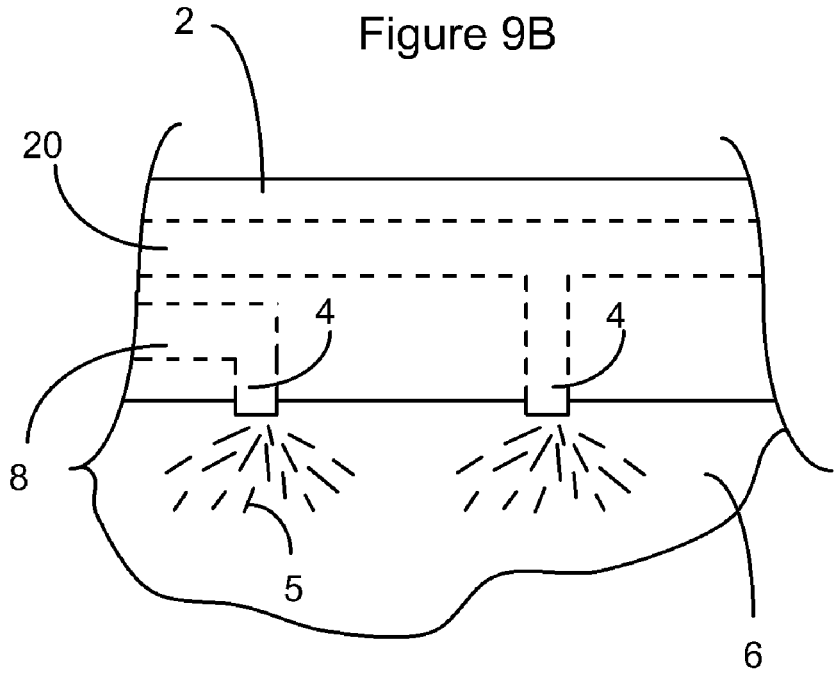
FIG. 9B is a side transparent view of a preferred embodiment of the invention in which multiple conduits concealed within the rub rail of a boat.

FIG. 9B is a side transparent view of a preferred embodiment of the automatic boat cleaning system in which multiple conduits 8, 20 are concealed within the rub rail 2 of a boat 1.

Figure 10:
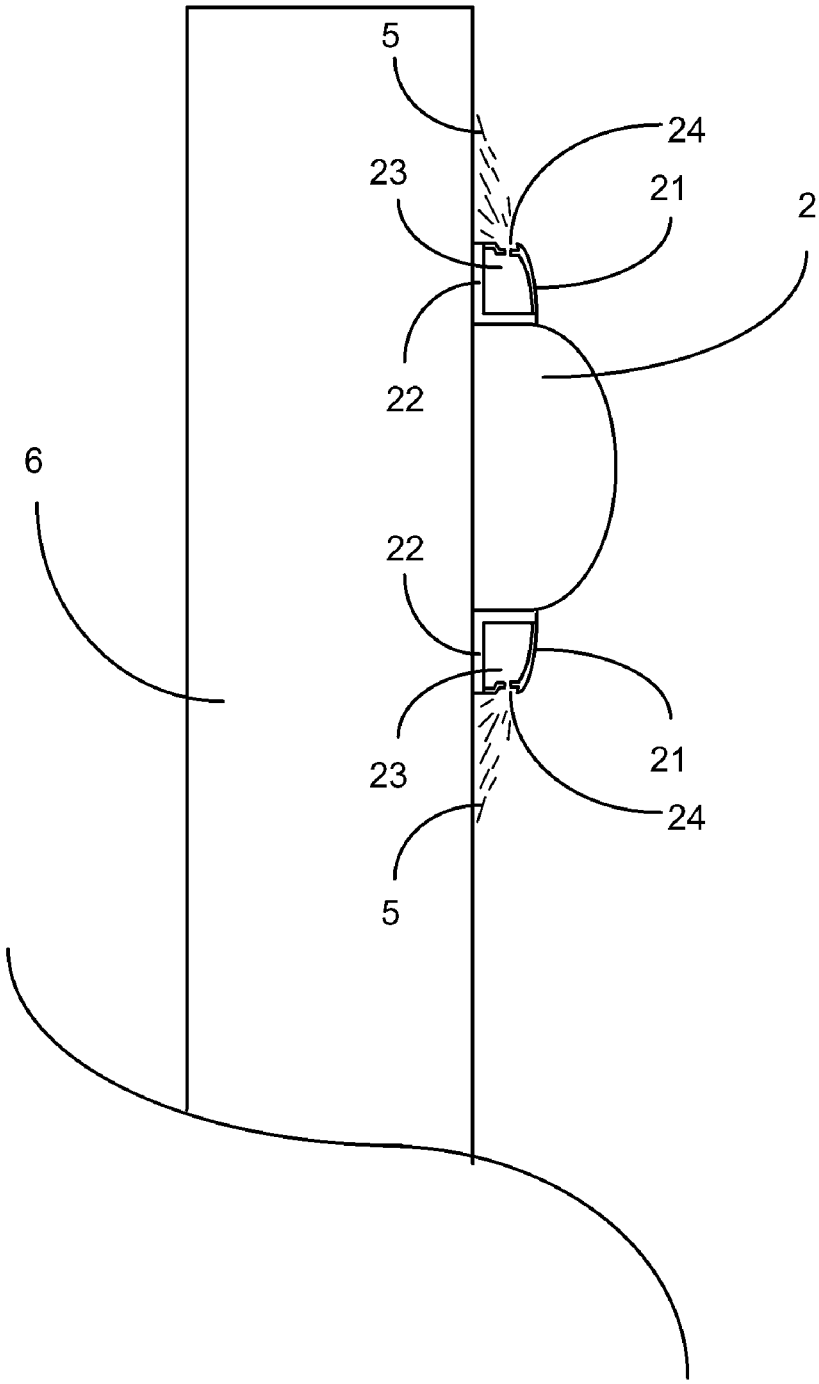
FIG. 10 is an alternative preferred embodiment in which the conduit is fabricated from flexible material and adhered to the surface of the boat.

FIG. 10 is an alternative preferred embodiment in which an alternative conduit 21 is fabricated from flexible material and is secured to the surface of the boat by an adhesive material 22 (e.g. double stick tape, adhesive, etc.). In addition, this figure illustrates an alternative fluid aperture which is formed by perforating the alternative conduit 21 in such a manner that cleaning fluid 5 is sprayed in a predetermined direction from fluid aperture 24. In this embodiment alternative conduit 21 has a conduit 23 which provides a path for the cleaning fluid 5. This embodiment provides an inexpensive method of retrofitting pre-existing boats 1 with the invention that a minimal amount of cost, and without modifying any pre-existing equipment on the boat 1. FIG. 10 also illustrates the use to dual conduits 21. In this figure, conduits 21 are mounted on both sides of the rub rail 2.

Those skilled in the art will recognize that alternative conduit 21 can be secured to the boat 1 at any convenient location. For example, it can be secured to the bottom of the rub rail 2, as shown, secured to the top of the rub rail to spray upward, or secured to any other desired location on the boat 1. The flexibility of alternative conduit 21 provides the ability to secure it to any size or shape boat 1. As was the case above, the alternative conduit 22 can be constructed such that it has multiple separate internal conduits to supply a zoned spray system.

Figure 11:
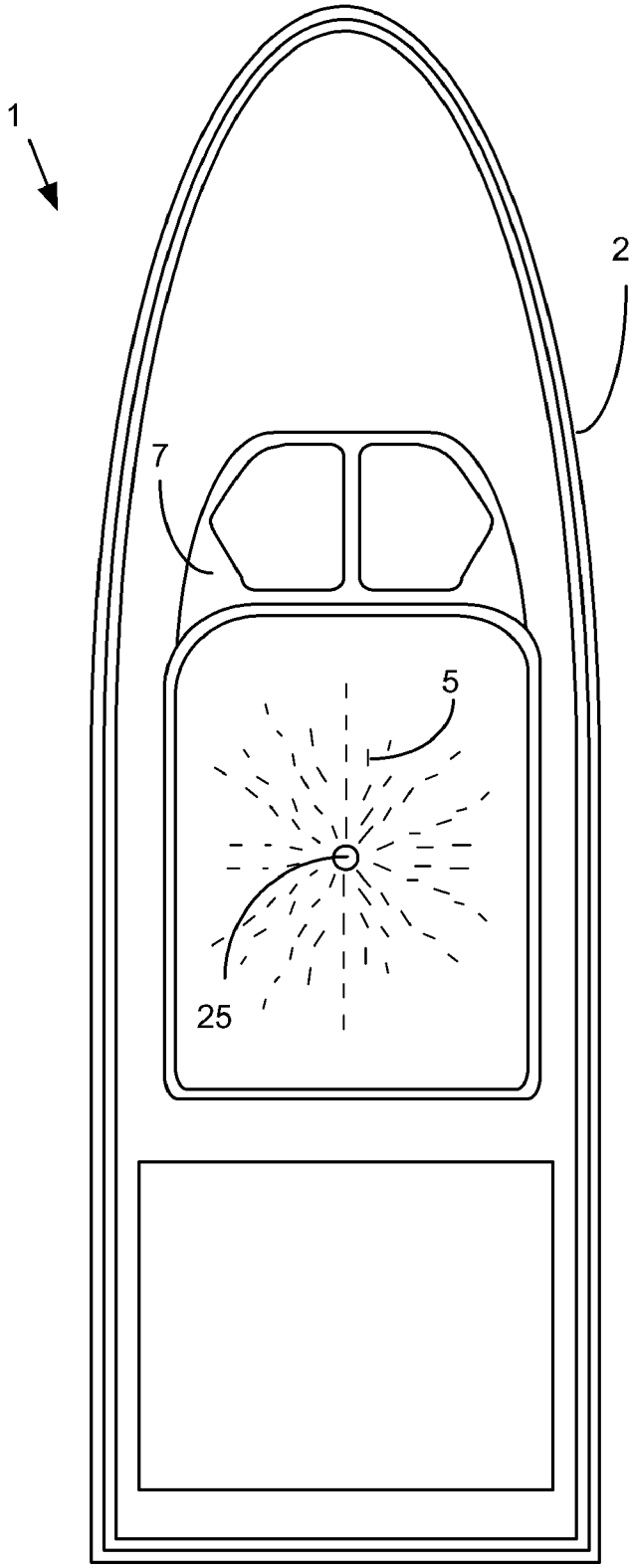
FIG. 11 is an alternative preferred embodiment in which a fixed sprinkler is positioned on the boat.

FIG. 11 is an alternative preferred embodiment in which a fixed sprinkler 25 is positioned on the boat 1. The use of sprinklers 25 such as this can provide coverage of large areas where the use of conduits may be unsightly. In addition, sprinklers 25 would also be useful in areas which are not easily reachable with a hose. As a practical matter, the sprinkler 25 would preferably be concealed as part of a structure on top of the boat 1, such as the radar scanner or VHF antenna found on many boats 1. For ease of illustration, the radar antenna was intentionally omitted from this drawing. In practice, the number of sprinklers 25 used for this purpose should have sufficient spray coverage to wash the entire roof of the boat 1. In addition, the sprinkler 25 can be designed as a retractable pop-up sprinkler which would only be visible when activated.

While spot-free chemicals can be used to rinse the boat 1 with a minimum amount of spotting, other optional features can also be used in conjunction with the invention. For example, an air blower, using either heated or ambient air can be used to force air through the conduits 8, 20 to speed the drying process after the boat 1 has been washed.

While specific embodiments have been discussed to illustrate the invention, it will be understood by those skilled in the art that variations in the embodiments can be made without departing from the spirit of the invention. The components used to fabricate the cleaning fluid conduit 8 can vary, the number and positions of the fluid apertures 4 can vary, the types of cleaning agents can vary, etc. Therefore, the invention shall be limited solely by the scope of the claims.

We claim:

1. An automatic cleaning system for cleaning the hull and the superstructure of a boat or vessel, comprising:

a plurality of conduits that are permanently attached to predetermined locations on the hull and superstructure of a boat or vessel, the conduits suitable for supplying water, cleaning fluids, waxes, and/or spot-free rinsing fluid;

each permanently attached conduit having one or more fluid outputs positioned such that water, cleaning fluids, waxes, and/or spot remover fluids sprayed from the fluid outputs are directed toward predetermined surface areas of the boat, and at least one of the plurality of conduits directing the sprayed water, cleaning fluids, waxes, and/or spot remover fluids in both upward and downward directions toward different surface areas of the boat;

the plurality of conduits distributed on the boat or vessel such that a first portion of the fluid outputs directs streams of water, cleaning fluids, waxes, and/or spot remover fluids directly at predetermined surface areas on the hull and a second portion of the fluid outputs directs streams of water, cleaning fluids, waxes, and/or spot remover fluids directly at predetermined surface areas on the superstructure such that when the streams of water, cleaning fluids, waxes, and/or spot remover fluids impact the surface of the hull and/or superstructure, those hull and/or superstructure surfaces are cleaned; and switch means to selectably activate the boat cleaning system at predetermined times;

whereby the boat or vessel is automatically cleaned under control of the boat cleaning system when the switch means are activated.

2. A system, as in claim 1, wherein:

the conduits are concealed within the rub rails.

3. A system, as in claim 1, wherein:

the conduits are routed within the bulkhead.

4. A system, as in claim 1, further comprising:

a water source for supplying water for distribution via the conduits.

5. A system, as in claim 4, further comprising:

an onboard water reservoir, the onboard water reservoir providing the water source.

6. A system, as in claim 4, further comprising:

a pump having an input from the water source, and an output that supplies water to the conduits.

7. A system, as in claim 5, further comprising:

one or more reservoirs for storing cleaning agents, and means to input the cleaning agents to the pump.

8. A system, as in claim 7, wherein:

the cleaning agents further comprise soap, wax, and/or spot-free rinse chemicals.

9. A system, as in claim 8, further comprising:

a cleaning agent reservoir.

10. A system, as in claim 8, further comprising:

a water reservoir; and a pump having an input from the water source, and an output that supplies water to the conduits.

11. A system, as in claim 10, further comprising:

a remote controller for automatically activating the boat cleaning system.

12. A system, as in claim 4, further comprising:

a timer for automatically activating the boat cleaning system.

13. A system, as in claim 4, further comprising:

means to remotely activate the boat cleaning system.

14. A system, as in claim 13, wherein:

the means to remotely activate the boat cleaning system is a cellular phone connection, or an Internet connection.

15. A method of automatically cleaning a boat or vessel, including the steps of:

spraying the surface of the boat or vessel from fluid outputs permanently positioned at predetermined locations on the surface of the boat or vessel;

permanently positioning a plurality of fluid outputs at predetermined locations on the surface of the boat or vessel and aiming a first portion of the fluid outputs such that they direct streams of water, cleaning fluids, waxes, and/or spot remover fluids directly at predetermined surface areas on the hull and aiming a second portion of the fluid outputs such that they direct streams of water, cleaning fluids, waxes, and/or spot remover fluids directly at predetermined surface areas on the superstructure such that when the streams of water, cleaning fluids, waxes, and/or spot remover fluids impact the surface of the hull and/or superstructure, those hull and/or superstructure surfaces are cleaned, and at least a portion of the plurality of fluid outputs located in a conduit, a first portion of the fluid outputs in the conduit direct the sprayed water, cleaning fluids, waxes, and/or spot remover fluids in an upward direction toward a first preselected surface area of the boat, and a second portion of the fluid outputs in the conduit direct the sprayed water, cleaning fluids, waxes, and/or spot remover fluids in a downward direction toward a second preselected surface area of the boat; and selectably activating under manual or automatic control the boat cleaning system at predetermined times;

whereby the hull and the superstructure of the boat or vessel is automatically cleaned under control of the boat cleaning system.

16. A method, as in claim 15, including the additional step of:

using concealed conduits to distribute water and/or cleaning fluids to the fluid outputs.

17. A method, as in claim 16, including the additional step of:

storing a supply of water and/or cleaning fluids in an onboard reservoir for distribution to the fluid outputs.

18. A method, as in claim 16, including the additional step of:

using a remote control, a timer, and/or a remote connection to control cleaning of the boat.

* * * * *